United States Patent [19]

Rowland, Jr.

[11] 3,991,892

[45] Nov. 16, 1976

[54] METHOD FOR EXTRACTING CONTENTS OF A PACKAGE

[75] Inventor: Wallace Loyd Rowland, Jr., Petersburg, Va.

[73] Assignee: Brown & Williamson Tobacco Corporation, Louisville, Ky.

[22] Filed: Mar. 27, 1975

[21] Appl. No.: 562,740

[52] U.S. Cl. ..... 214/152; 53/381 R

[51] Int. Cl.[2] ..... B65G 65/04

[58] Field of Search ..... 214/8.5 G, 300, 304, 214/305, 310, 309, 152; 206/242, 271, 274; 229/87 C, 51 C; 53/381 R

[56] References Cited

UNITED STATES PATENTS

| | | | |
|---|---|---|---|
| 453,264 | 6/1891 | Maloney | 229/87 C |
| 1,186,519 | 6/1916 | Schneider | 206/274 |
| 1,999,135 | 4/1935 | Back | 229/87 C |
| 2,266,547 | 12/1941 | Goodwin | 229/51 SC |
| 3,238,926 | 3/1966 | Huck | 214/304 |
| 3,863,790 | 2/1975 | Kanarek | 214/305 |
| 3,889,442 | 6/1975 | Grahn et al. | 214/305 |

FOREIGN PATENTS OR APPLICATIONS

| | | | |
|---|---|---|---|
| 620,058 | 10/1934 | Germany | 214/304 |

*Primary Examiner*—Robert J. Spar
*Assistant Examiner*—Lawrence J. Oresky
*Attorney, Agent, or Firm*—William J. Mason

[57] ABSTRACT

A method for extracting the contents of a package by sequentially moving packages from a storage area to a dwell position in which the outer wrap is removed while holding the inner wrap and the contents of the package motionless. The inner wrap is then moved with the contents to a second position in which the inner wrap is removed while holding the contents essentially stationary. Once the inner wrap is removed, the free contents of the package are transported from the area where the inner wrap was removed.

6 Claims, 8 Drawing Figures

METHOD FOR EXTRACTING CONTENTS OF A PACKAGE

BACKGROUND OF THE INVENTION

This invention relates to the opening of packages, particularly to the opening of cigarette packages, to reclaim the cigarettes therein. When packages containing products, such as cigarettes, are rejected due to defects, it is extremely important that the products be reclaimed. The prior art is replete with complicated reclaiming devices which require slitting the package so as to divide the package into parts with subsequent tumbling to dislodge the products. Such apparatus and methods are viewed by most as awkward and complex. It is, therefore, a paramount object of the present invention to provide a simple and efficient apparatus and method for opening packages, particularly cigarette packages, to reclaim the products therein.

SUMMARY OF THE PRESENT INVENTION

Applicant has attained the object above and other objects by providing an apparatus comprising a storage means for holding a plurality of packages with the "major surface" having the overlapped edge of the inner wrap facing up, a means for sequentially moving a package to a first position in which movement is interrupted, a holding means for restraining movement of the inner wrap and contents at the first position, means for removing the outer wrap at the first position, and means for engaging the overlapped edge of the inner wrap and removing said inner wrap.

DESCRIPTION OF THE PREFERRED EMBODIMENT

Figure 1:
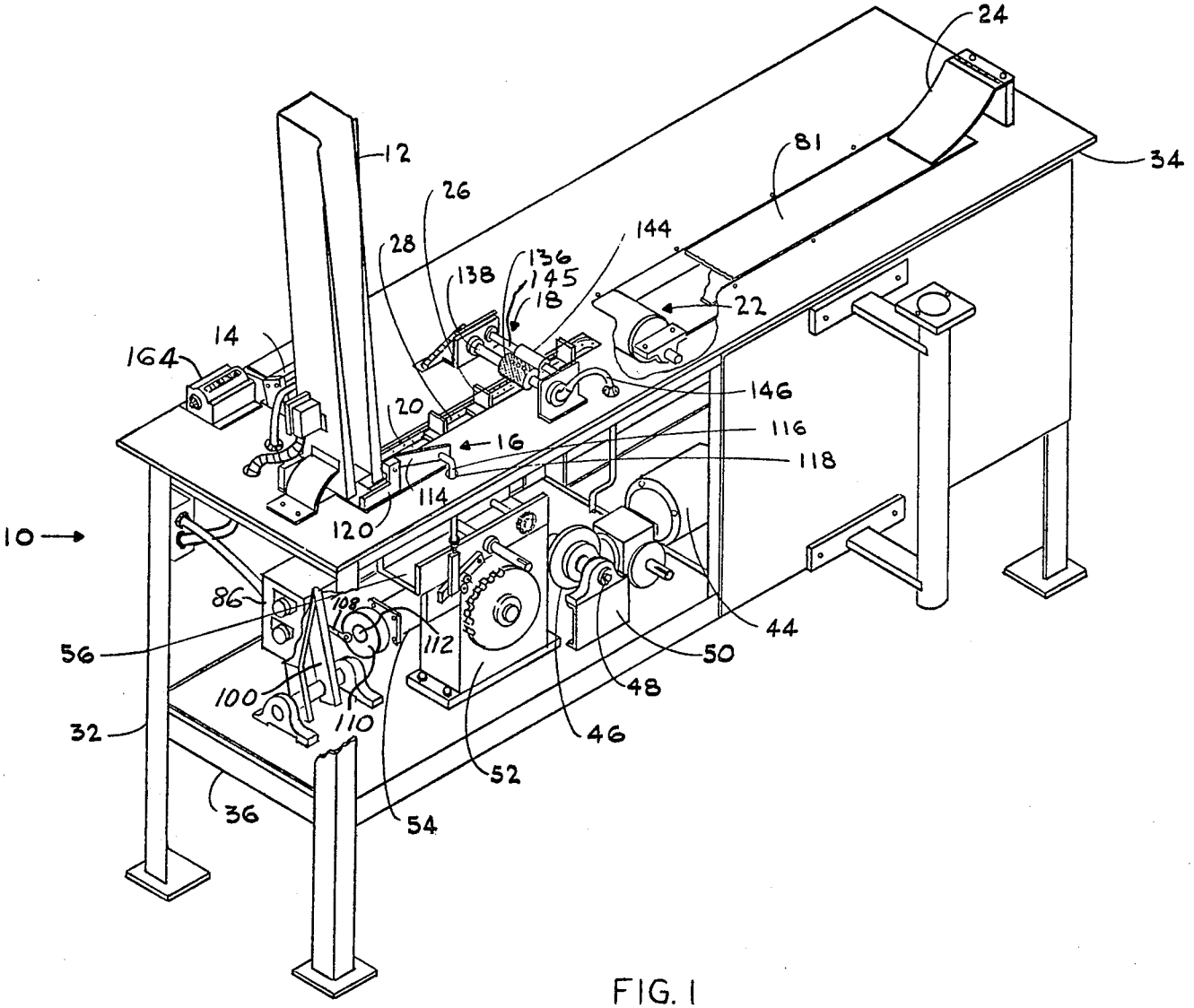
FIG. 1 illustrates an apparatus in accordance with an embodiment of the invention with portions of the frame partially broken away.

The illustration of FIG. 1 depicts, in perspective, an apparatus 10 comprising a frame structure 32 and platforms 34, 36. Positioned on or adjacent to platform 34 are a hopper 12, a label removing assembly indicated generally as 14, a holding assembly designated generally as 16 and a foil removal assembly 18. Hopper 12 serves as a vertical storage bin for a plurality of packages.

A narrow channel 20 extends from beneath hopper 12 to conveyor assembly 22. Beyond conveyor assembly 22 is a deflector 24 which aids in gathering the cigarettes once the package has been removed.

A plurality of upright members or lugs 26 attached to endless chain 28 extend upward through and are positioned for movement along channel 20. Hopper 12 gravity feeds packages down to channel 20 where lugs 26 remove the bottom package from hopper 12 and carry it along channel 20.

Figure 2:
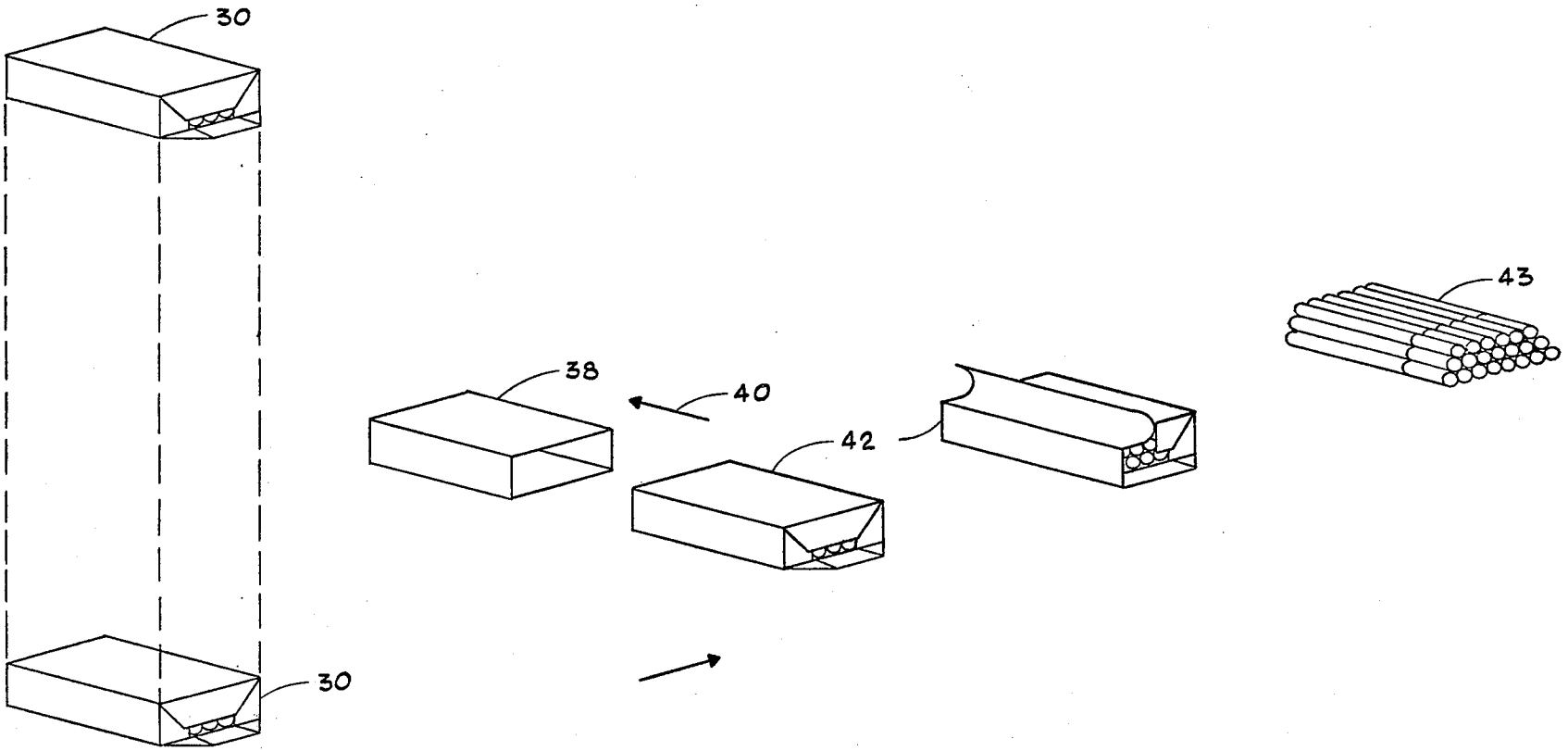
FIG. 2 illustrates a manipulative sequence of a package in which the inner and outer wrappings are being removed in accordance with the invention.

Generally, the manipulative sequence is as illustrated in FIG. 2. The packages 30, seen in hopper 12, are essentially parallelepiped in configuration and disposed in hopper 12 with a predetermined major surface facing upward. The construction of packages 30 are standard and consist of an inner wrapping primarily designed to keep the contents fresh and an outer wrapping primarily designed for protection of the contents and identification. For simplicity, the inner and outer wrappings will be called the foil and label, respectively. Generally, the outer wrapping encloses the packages on all sides, except at the front end. The foil completely encloses the product, being folded at the ends and overlapping along one "major surface." Major surface is used herein to describe one of the two surfaces having the larger surface area. For example, cigarette packages are predominantly formed in this manner with the outer and inner wrappings being independent of one another.

When the package 30 moves from hopper 12 in a direction substantially transverse to its longitudinal axis into a first dwell position as indicated by FIG. 2, label 38 is removed in the direction indicated by arrow 40. Simultaneously, a portion of foil 42 (herein the bottom flap) is held to prevent movement thereof or the articles enclosed. As noted, the direction of removal is opposite from the front end of the pack. Package 30 then continues its movement to a second dwell position where the foil 42 is removed by rolling it away from articles 43. To effect this rolling action, it is preferred that the package be arranged so that the package moves in a direction toward which the end of foil 42 is extending.

On platform 34, the first dwell position is adjacent hopper 12 and between label removing assembly 14 and holding assembly 16. The second dwell position is adjacent foil removal assembly 18.

Figure 5:
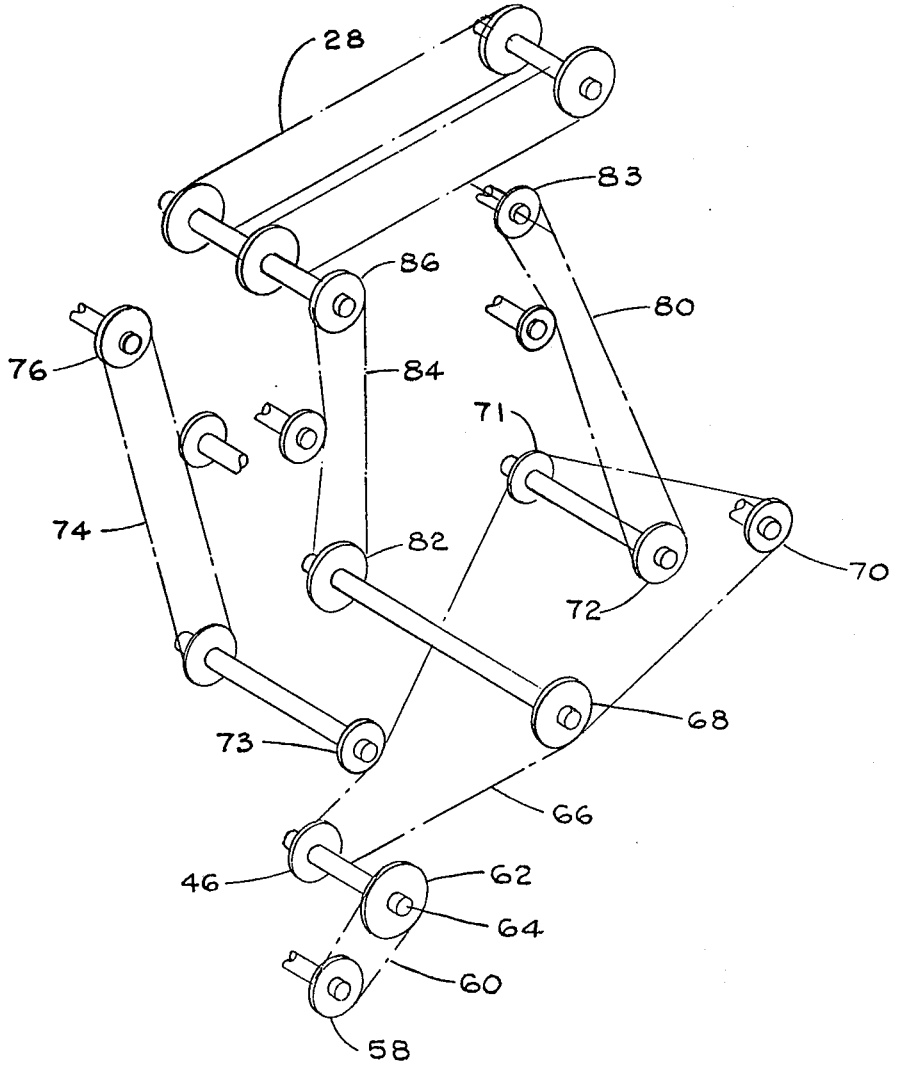
FIG. 5 is a schematic illustrating the drive sprocket layout of an apparatus of the present invention.

In order to better understand the operative relationship between the various driving components, reference is now made to FIGS. 1 and 5, the latter being a schematic of the various sprocket and chain drives. A motor 44 is mounted on and secured to platform 36. Adjacent to motor 44 is clutch assembly 46 which is mounted on shaft 48 journaled into brackets 50 secured to platform 36. A geneva gear assembly 52 positioned on the other side of clutch assembly 46 is also secured to platform 36. An angle drive 54 is secured to the underside of platform 34 by overhead bracket 56.

Figure 4:
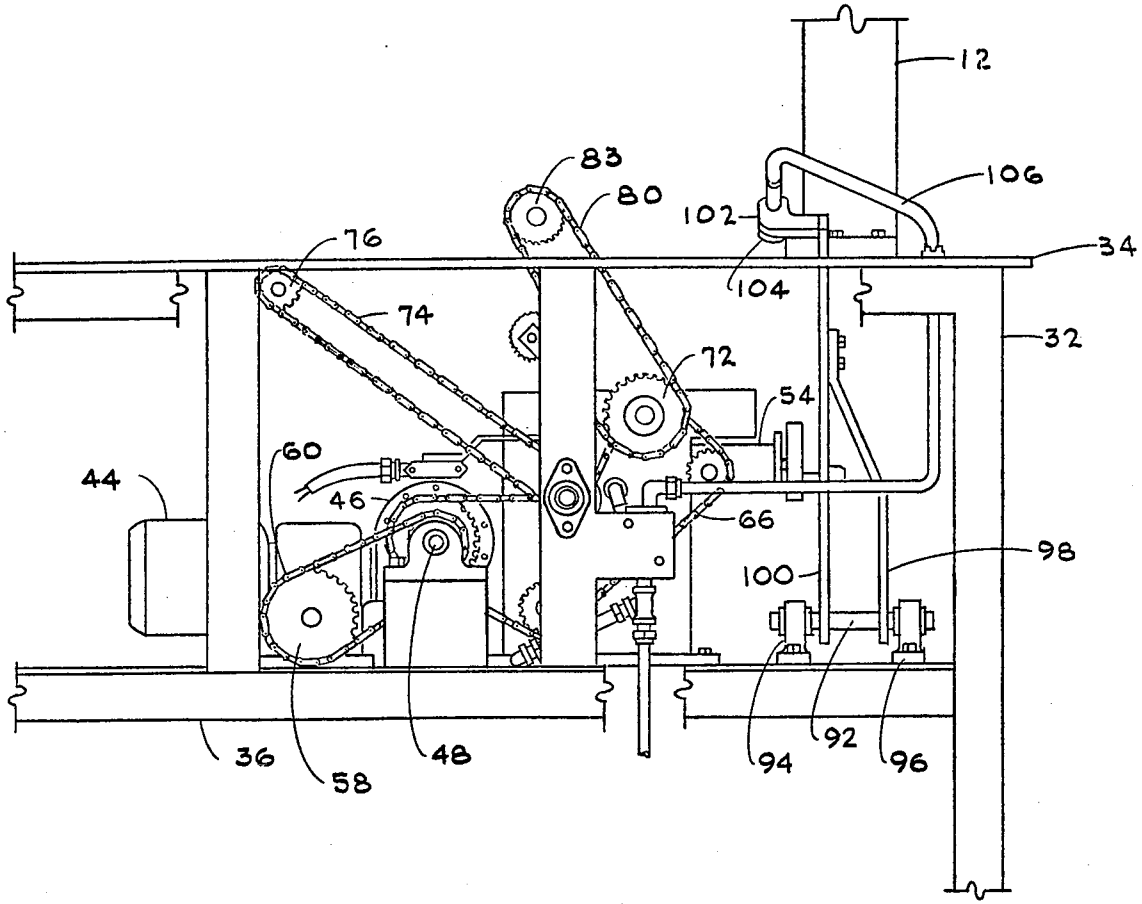
FIG. 4 is an elevation view of part of the other side of the apparatus of FIG. 1.

Referring now specifically to FIGS. 4 and 5, it will be seen that motor 44 has an output sprocket 58, which, through chain 60, drives sprocket 62 and shaft 64 of clutch assembly 46. Clutch 46 serves to drive the major operating components of apparatus 10. Main drive chain 66 rotates geneva input sprocket 68, angle drive input sprocket 70, sprocket 71, sprocket 72 of foil pick-up assembly 18, and conveying assembly input sprocket 73. Chain 74 directly drives sprocket 76 of conveying drum 78 (see FIG. 1) and belt 81 of conveying assembly 22, while chain 80 directly drives sprocket 83 of foil removal assembly 18.

Figure 3:
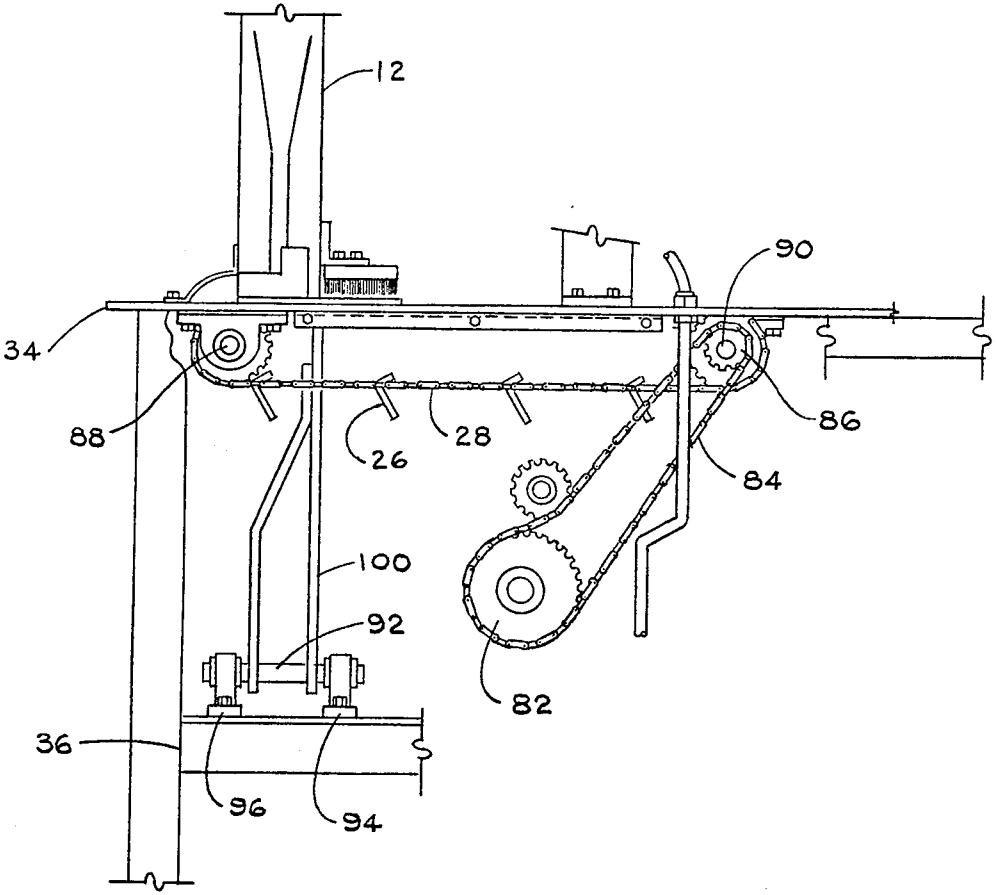
FIG. 3 is an elevation view of part of one side of the apparatus of FIG. 1.

Geneva gear assembly 52 drives chain 28 via output sprocket 82, chain 84 and lug chain input sprocket 86. As seen in FIG. 3, chain 28 is mounted for movement about shafts 88, 90 secured to brackets beneath support platform 34. Angle drive 54 serves two functions in that it drives both label removing assembly 14 and holding assembly 16.

Label Removing Assembly

The label removing assembly 14 is best described in reference to FIGS. 1, 3, and 4. A shaft 92 is mounted for rotating movement between support brackets 94, 96, which are secured to platform 36. A pair of upright arms 98, 100 are secured to shaft 92. Upright arm 98 is angled and secured to upright arm 100 just below platform 34. Upright arm 100 extends through an opening in platform 34 wherein an arm 102 integral with upright arm 100 extends outward over the surface of platform 34. The end of arm 102 is provided with an internal channel which communicates with a flexible rubber cup 104 mounted on the under surface of arm 102 and with one end of an air hose 106 fitted in an air-tight manner to the top surface of arm 102. Referring now to FIG. 1, upright arm 100 is pivotably connected to crank arm 108, which in turn is pivotably connected to crank cam 110 mounted on the output shaft 112 of angle drive 54. The vacuum to cup 104 may be supplied by any conventional means.

Foil Holding Assembly

Figure 6:
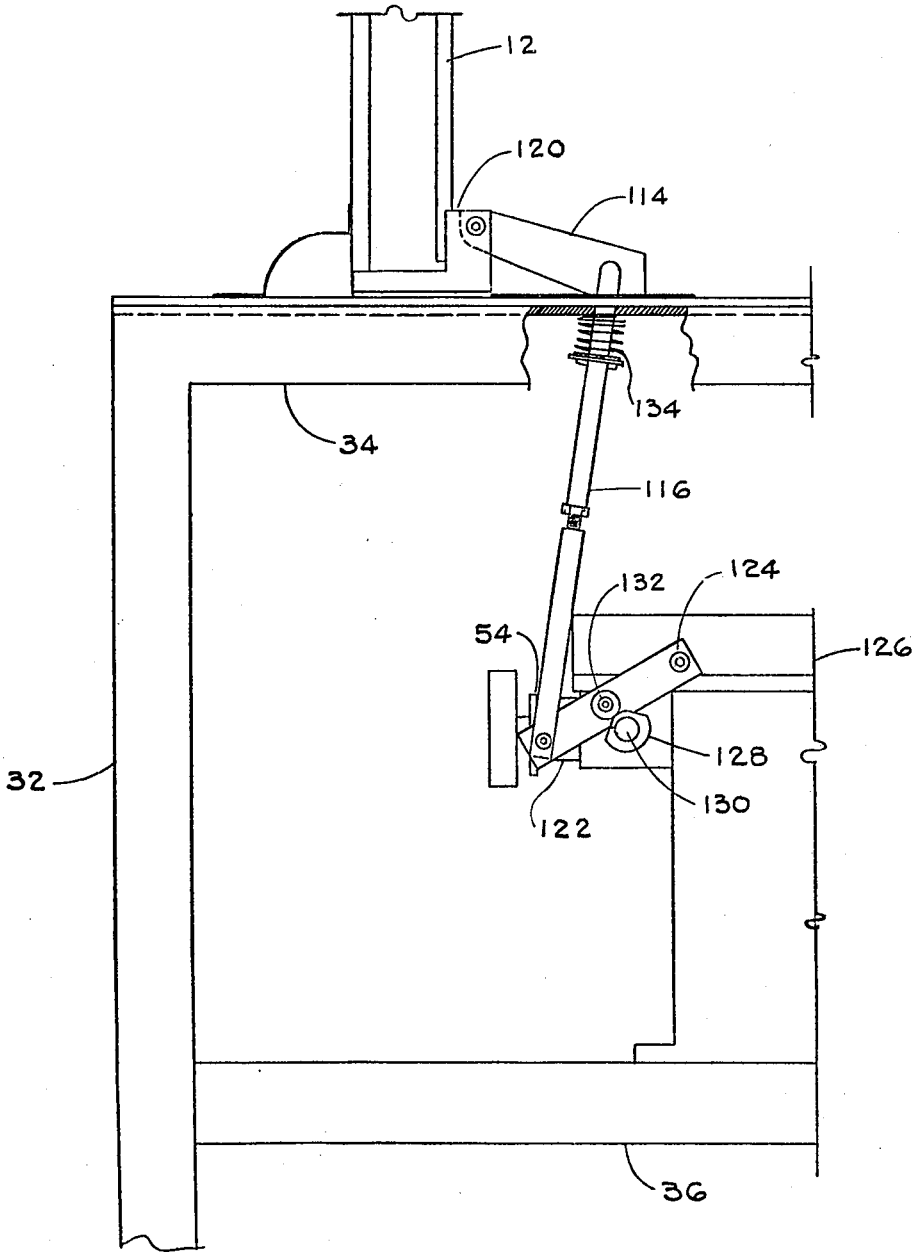
FIG. 6 is an enlarged side view of the holding arm assembly.

Continuing the reference to FIG. 1, it is seen that holding assembly 16 comprises generally a holding plate 114 and vertical arm 116, which extends downward through opening 118 in platform 34. Vertical arm 116 is angled to extend laterally over platform 34 and is affixed to one end of plate 114. The other end of plate 114 is pivotably attached to a bracket 120 secured to platform 34. The enlarged view of FIG. 6 illustrates that the lower portion of vertical arm 116 is pivotably secured to one end of a follower arm 122. The other end of follower arm 122 pivots about shaft 124 journaled into the upright support structure 126 of geneva drive assembly 52. A cam 128 is rotatably secured to support structure 126 via a shaft 130 and is continuously driven by angle drive 54. The drive to shaft 130 is provided by clutch assembly 46. Cam follower 132 secured to arm 116 is biased against cam 128 by spring 134 which is positioned about arm 116 and compressed against the under surface of platform 34.

Foil Removing Assembly

Figure 7:
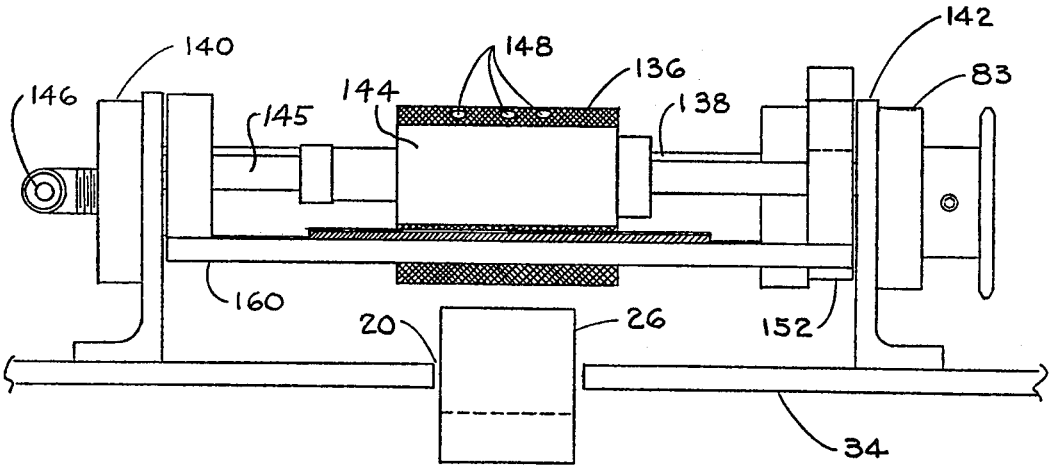
FIG. 7 is an end view of the foil removal assembly.
Figure 8:
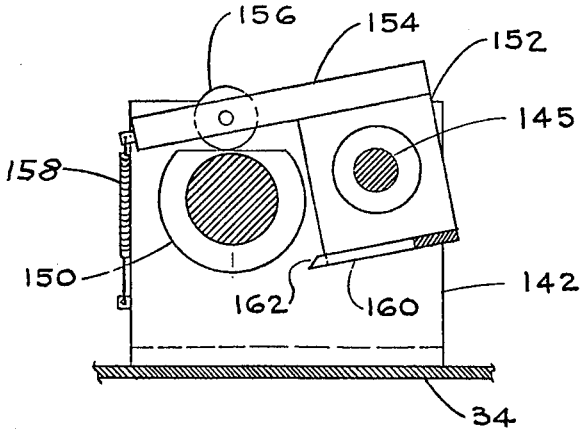
FIG. 8 is a cross-sectional view of the cam and follower arm as seen in FIG. 7.

Foil removing assembly 18, seen generally in FIG. 1, but in more detail in FIGS. 7 and 8, comprises, in part, a vacuum roller 136 secured to a shaft 138 rotatably mounted between and journaled into a pair of right angle plates 140, 142, which are secured to platform 34. Nip roller 144 is similarly mounted on shaft 145. Both vacuum roller 136 and nip roller 144 are positioned above channel 20 in support platform 34. Roller 136 contains an interior channel which extends through shaft 138 to air hose 146, which is connected thereto in an appropriate air-tight relationship. As illustrated in FIG. 7, roller 136 is provided with a plurality of openings 148, which communicate with the interior channel. The vacuum may be provided by any conventional means.

As best seen in FIG. 8, a cam 150 is secured to one end of shaft 138 and positioned against plate 140. Rocker plate 152 rotatably journaled about shaft 145 is integral to and supports arm 154, which rides against cam 150 via cam follower 156. Spring 158 secured at one end to plate 152 and at the other to the end of arm 154 provides a downward bias to arm 154. Integral with, but extending at a right angle to rocker plate 152, is a foil contact plate 160, which is rotatably secured at the other end of shaft 145. Plate 160 is further provided with a beveled edge 162. As cam 150 rotates the biased follower arm 154 causes plate 152 to rock and beveled edge 162 to alternatively approach and recede from the under surface of vacuum roller 136.

Operation of the Apparatus

The apparatus is energized for automatic operation through depression of the on-switch of switch box 86. Alternatively, an operator could manually operate the machine by manipulating a handwheel, which rotates sprocket 71, and, therefore, main drive chain 66. Continuing with the automatic sequence, however, activation of motor 44 causes rotation of clutch assembly 46, which drives both geneva assembly 52 and angle drive 54. Chain 28 moves a lug 26 through a portion of hopper 12 engaging the bottom package and carrying along channel 20. At a point adjacent label removing assembly 14 and holding assembly 16, the geneva output sprocket 82 ceases rotation causing chain 28 and lugs 26 to stop. Continuous motion, however, is provided to angle drive 54, which during this interval has rotated crank cam 110 such that crank arm 108 causes laterally extending arm 102 of upright arm 100 to move toward the stationary package. Cup 104 contacts the upper major surface. Simultaneously, cam 128 of the foil holding assembly 16 rotates such that follower 132 and arm 116 are permitted to move downward, thereby causing plate 114 to rotate toward and restrain the extended flap of the inner wrap or foil of the package against platform 34.

As soon as plate 114 restrains the foil wrap, crank cam 110 reaches a position causing upright arm 100 to pivot away from the package. The vacuum in cup 104 results in the label wrap adhering thereto and sliding off the restrained inner wrap and contents. It may be desirable to employ a counter 164 (see FIG. 1) which is actuated by upright arm 100 each time it is pivoted away from a package.

Upon removal of the label, cam 128 forces follower 132, arm 116, and plate 114 upward to release the foil. Subsequently, geneva gear assembly 52 again rotates sprocket 82, driving chain 28 carrying the foil wrap and contents to a position adjacent vacuum roller 136. At this position, sprocket 82 ceases rotation. Roller 136 is continuously driven and the vacuum openings 148 contact the leading portion of the foil and begin to pull the foil off. Roller 136 may be knurled or otherwise provided with a friction surface to promote gripping of the foil. Foil contact plate 160 is in the open position as the leading edge of the foil passes under roller 136. At this point, cam 150 forces follower 156 and riding arm 154 upward, causing rocker plate 152 to rotate clockwise about shaft 145 such that the beveled edge 162 of plate 160 approaches roller 136. The edge 162 ensures that the foil passes between roller 136 and nip roller 144.

Once the foil inner wrap is removed, sprocket 82 again drives chain 28 forward. Simultaneously, cam 150 permits counter-clockwise rotation of plate 154, moving plate 160 away from roller 136. The products now unrestrained are moved to conveyor belt 81, which carries the product to a deflector 24, whereupon the product may be removed by any conventional means. The discarded wrappings may also be removed as desired, as, for example, by an appropriate pneumatic pick-up means.

While specific embodiments have been described with reference to the accompanying drawings, it is to be understood that various modifications and alterations may be made in light of the descriptive matter herein without departing from the scope and spirit of the appended claims.

It is claimed:

1. A method of extracting articles from a substantially parallelepiped package having inner and outer wrappings wherein the outer wrapping encloses the inner wrapping except at one end thereof and the inner wrapping encloses and overlaps the articles to provide a leading edge extending longitudinally along one major surface thereof comprising the steps of:

a. placing the package with the one major surface thereof up;

b. intermittently moving said package in a direction substantially transverse to its longitudinal axis;

c. holding the inner wrapping and articles therein substantially motionless during a first dwell period while removing the outer wrapping in the direction opposite the one end; and d. gripping the inner wrapping along the leading edge and rolling the inner wrapping away from the articles during a second dwell period, while holding the contents of the package essentially stationary, thereby freeing the articles therein.

2. The method of claim 1, including the initial step of storing a plurality of packages in a vertical stack with the one major surface thereof up and sequentially removing the bottom package in the stack.

3. The method of claim 1 wherein the step of removing said outer wrapping comprises contacting said outer wrapping with an adhering member and moving said member to slide said outer wrapping off one end of said package.

4. The method of claim 1 wherein said inner wrapping and said articles are held motionless by restraining a protruding portion of said inner wrapping.

5. The method of claim 1 wherein the step of gripping the inner wrapping includes contacting said inner wrapping with a roller using a vacuum to grip said inner wrapping.

6. The method of claim 1 wherein the step of gripping the inner wrapping includes passing the inner wrapping between a pair of opposed rollers.

* * * * *